US009909721B1

(12) United States Patent
Deng et al.

(10) Patent No.: US 9,909,721 B1
(45) Date of Patent: Mar. 6, 2018

(54) REPLACEABLE LED LAMP

(71) Applicant: DONGGUAN PAN AMERICAN ELECTRONICS CO., LTD, DongGuan (CN)

(72) Inventors: Jinsheng Deng, DongGuan (CN); Xiaoyun Zeng, DongGuan (CN); Shilin Tang, DongGuan (CN)

(73) Assignee: DONGGUAN PAN AMERICAN ELECTRONICS CO., LTD., DongGuan (CN)

( * ) Notice: Subject to any disclaimer, the term of this patent is extended or adjusted under 35 U.S.C. 154(b) by 0 days.

(21) Appl. No.: 15/414,524

(22) Filed: Jan. 24, 2017

(30) Foreign Application Priority Data

Nov. 22, 2016 (CN) ..... 2016 1 1036042
Nov. 22, 2016 (CN) ..... 2016 2 1257601 U

(51) Int. Cl.

| | |
|---|---|
| ***F21V 1/00*** | (2006.01) |
| ***F21V 5/00*** | (2015.01) |
| ***F21V 7/00*** | (2006.01) |
| ***F21K 9/275*** | (2016.01) |
| ***F21K 9/278*** | (2016.01) |
| ***F21V 3/02*** | (2006.01) |
| ***F21K 9/272*** | (2016.01) |
| ***F21V 15/015*** | (2006.01) |
| ***F21V 29/83*** | (2015.01) |
| ***F21V 21/02*** | (2006.01) |

(Continued)

(52) U.S. Cl.
CPC ..... *F21K 9/275* (2016.08); *F21K 9/272* (2016.08); *F21K 9/278* (2016.08); *F21V 3/02* (2013.01); *F21V 7/005* (2013.01); *F21V 15/015* (2013.01); *F21V 21/025* (2013.01); *F21V 29/83* (2015.01); *F21Y 2103/10* (2016.08); *F21Y 2115/10* (2016.08)

(58) Field of Classification Search
CPC . F21K 9/27; F21K 9/272; F21K 9/275; F21K 9/278; F21S 8/026; F21S 8/031; F21S 8/04; F21S 8/043; F21V 21/025
See application file for complete search history.

(56) References Cited

U.S. PATENT DOCUMENTS 7,229,192 B2 * 6/2007 Mayfield, III ..... F21S 8/04 362/223
2011/0310604 A1 * 12/2011 Shimizu ..... F21V 3/0445 362/235

(Continued)

*Primary Examiner* — Alexander Garlen
(74) *Attorney, Agent, or Firm* — Platinum Intellectual Property LLP

(57) ABSTRACT

A replaceable LED lamp is configured to be mounted on a lamp bracket, the lamp bracket includes a lamp bracket bottom wall and two lamp bracket sidewalls extending from opposite sides of the lamp bracket bottom wall along the same direction, the replaceable LED lamp includes: a lamp housing; a power drive mounted on a surface of the lamp housing facing the lamp bracket; a lamp strip mounted on a surface of the lamp housing opposite to the lamp bracket; two latching edges fixed to opposite sides of the lamp housing; a lampshade covering the lamp strip; and a plurality of mounting plates connecting the lamp housing to the lamp bracket; wherein each latching edge defines a latching groove, the lampshade includes two latching lugs on opposite sides thereof, the latching lug is plugged in the latching groove.

8 Claims, 8 Drawing Sheets

(51) Int. Cl.
*F21Y 115/10* (2016.01)
*F21Y 103/10* (2016.01)

(56) References Cited

U.S. PATENT DOCUMENTS

2012/0201032 A1* 8/2012 Holten ..... F21S 8/00
362/296.01
2014/0355272 A1* 12/2014 Chou ..... F21S 4/008
362/308
2015/0247625 A1* 9/2015 Rodgers ..... F21V 23/02
362/222

* cited by examiner

REPLACEABLE LED LAMP

FIELD OF THE INVENTION

The present disclosure relates to lamps, and more particularly, relates to a replaceable LED lamp.

BACKGROUND OF THE INVENTION

The conventional fluorescent lamp has defects of high frequency flicker, poor color rendering, high power consumption, fast luminance decrease and so on. At present, the fluorescent lamp is replaced by a new energy LED lamp gradually.

Currently, the new energy LED lamps are launched into market rapidly, and the species emerge endlessly. The conventional bracket lamp and the fluorescent tube lamp should be replaced by a large quantity of LED lamps, if the LED lamps are overall placed, it requires a high labor cost and a large working quantity. In order to meet a requirement of a replacement of the large quantity of original linear lamps, a replaceable lamp having an easy operation and simple assembly is required, which can perform an assembly and a replacement directly on the original lamp bracket.

SUMMARY

Accordingly, it is necessary to provide a replaceable LED lamp which has an easy operation, a simple assembly and can perform an assembly and a replacement directly on an original lamp bracket.

A replaceable LED lamp, configured to be mounted on a lamp bracket, the lamp bracket includes a lamp bracket bottom wall and two lamp bracket sidewalls extending from opposite sides of the lamp bracket bottom wall along the same direction, the replaceable LED lamp includes: a lamp housing; a power drive mounted on a surface of the lamp housing facing the lamp bracket; a lamp strip mounted on a surface of the lamp housing opposite to the lamp bracket; two latching edges fixed to opposite sides of the lamp housing; a lampshade covering the lamp strip; and a plurality of mounting plates connecting the lamp housing to the lamp bracket; wherein each latching edge defines a latching groove, the lampshade includes two latching lugs on opposite sides thereof, the latching lug is plugged in the latching groove.

Aforementioned replaceable LED lamp has a simple structure and a simple assembly. When replacing, it merely requires dismantling the original lamp tube, and a replacement of the overall original lamps is eliminated. The replaceable lamp is directly mounted on the original lamp bracket, and the replacement is thus accomplished, thus it is labor saving.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE EMBODIMENTS

Embodiments of the invention are described more fully hereinafter with reference to the accompanying drawings, in which preferred embodiments of the invention are shown. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art It will be understood that when an element is referred to as being "fixed to" to another element, it can be directly fixed to the other element or intervening elements may be present. When an element is referred to as being "connected" or "coupled" to another element, it can be directly connected or coupled to the other element or intervening elements may be present Unless otherwise defined, all terms used herein have the same meaning as commonly understood by one of ordinary skill in the art to which this invention belongs. Terms in the description of the invention are for the purpose of describing specific embodiments, and are not intend to limit the invention.

Figure 1:
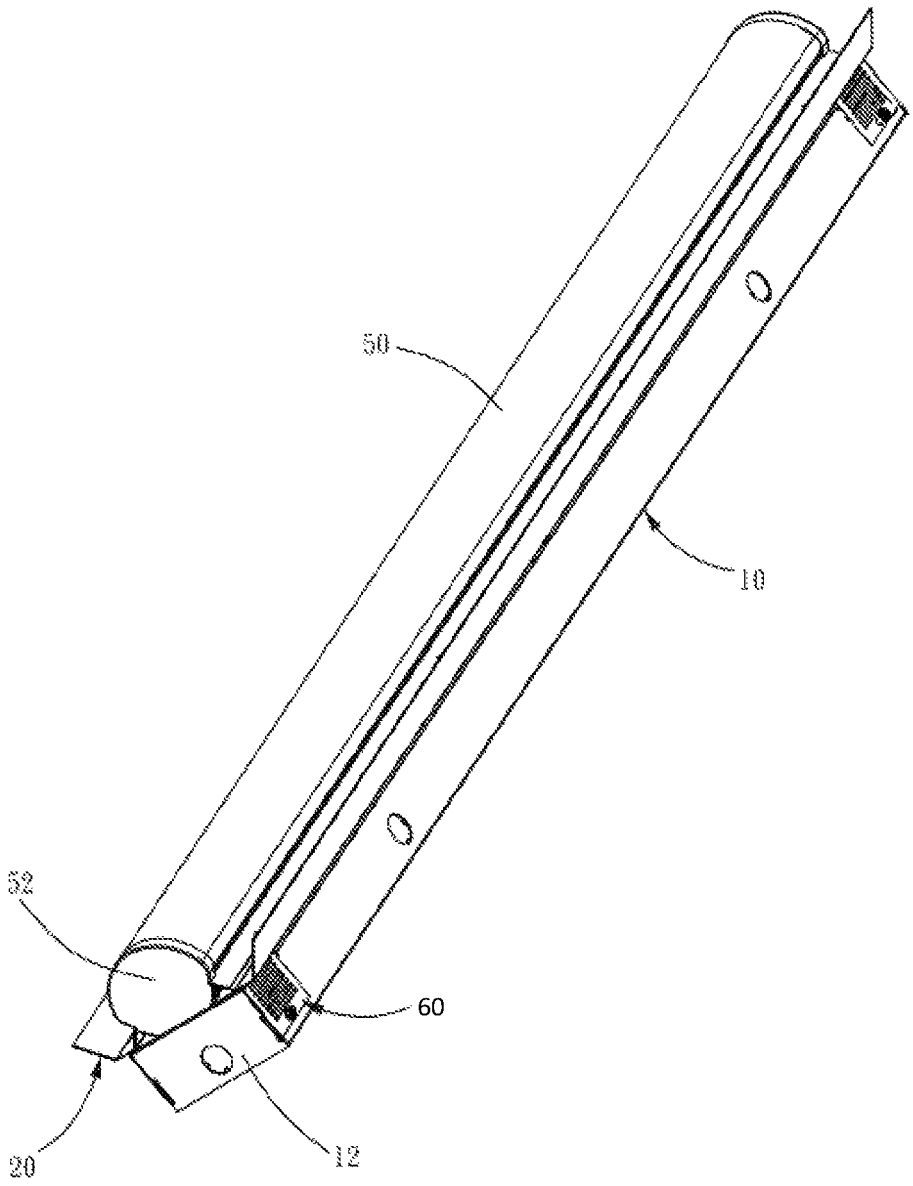
FIG. 1 is an assembled and perspective view of a replaceable LED lamp.
Figure 2:
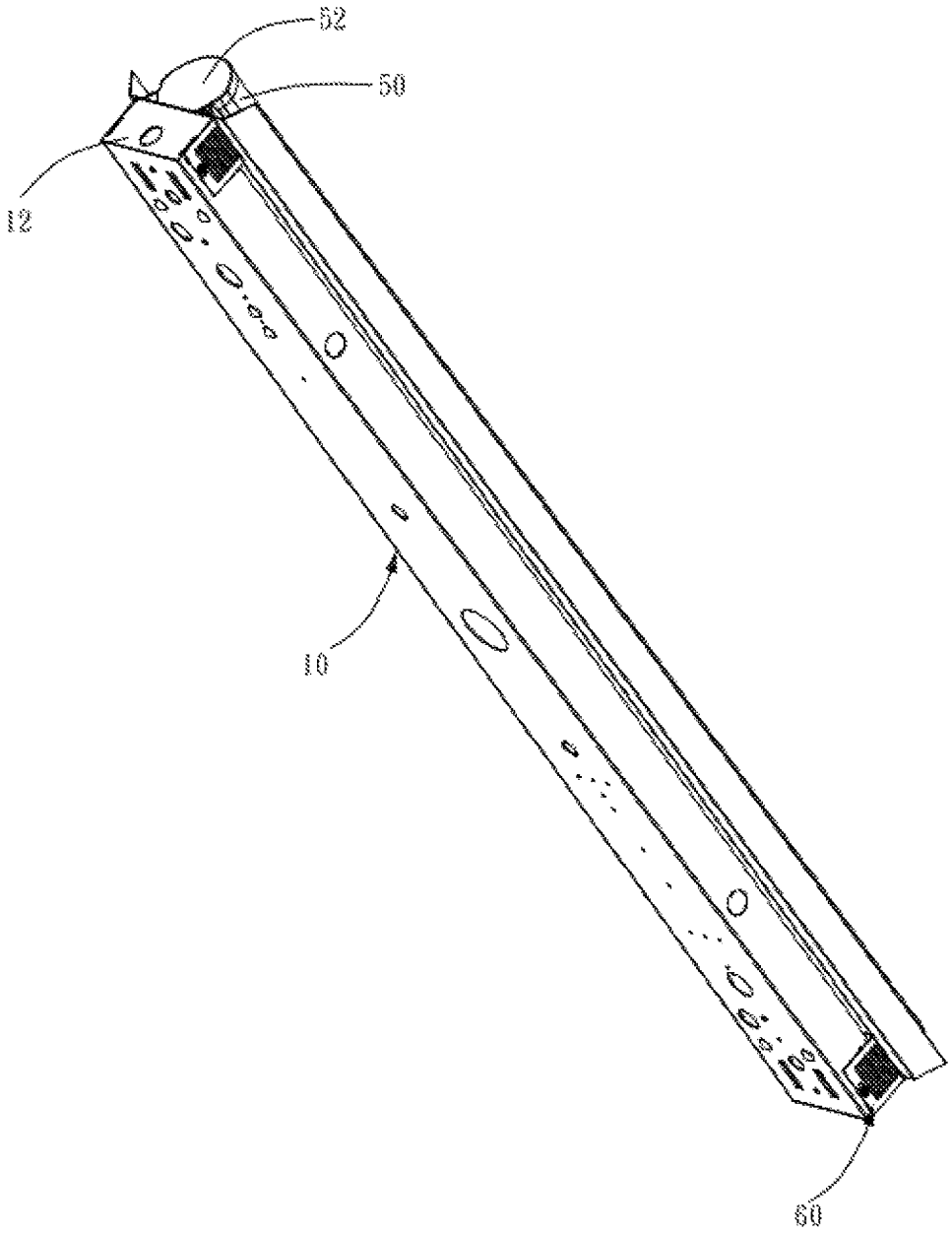
FIG. 2 is similar to FIG. 1, but viewed from another aspect.
Figure 3:
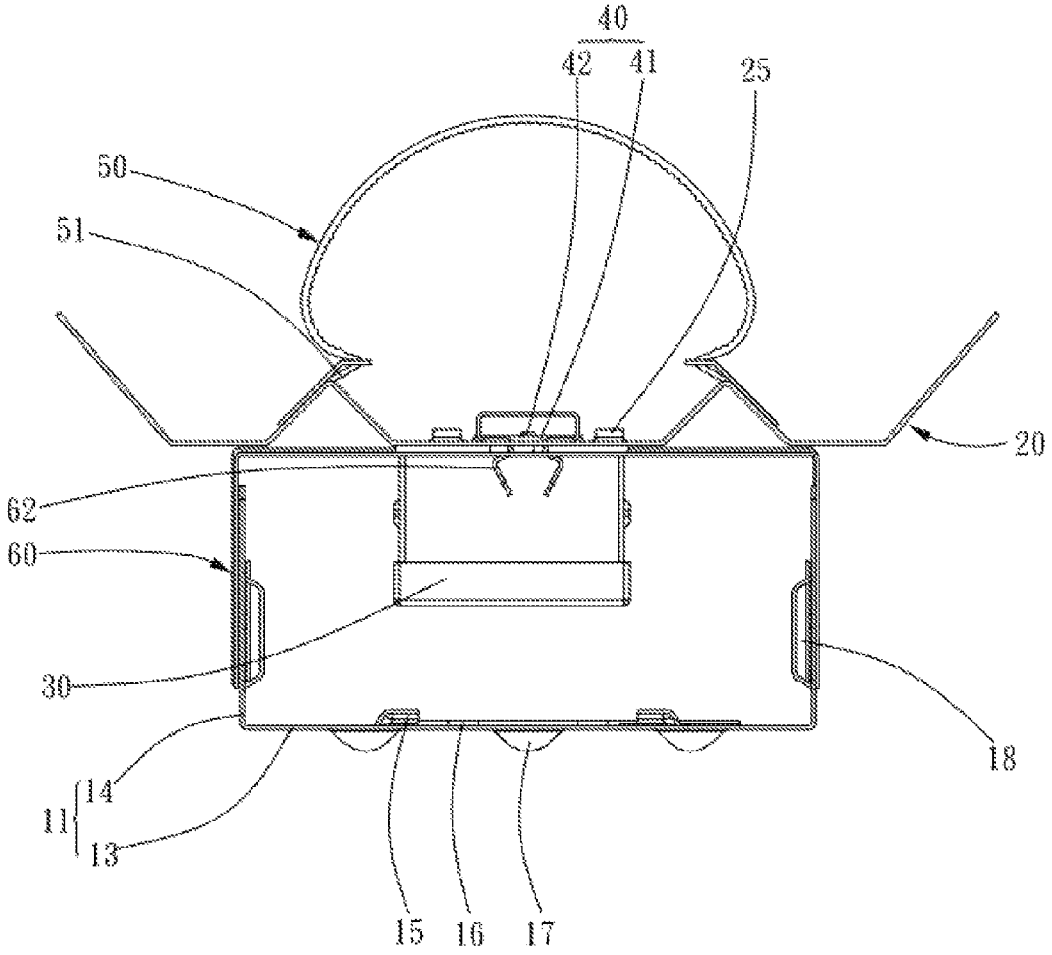
FIG. 3 is a left view of the replaceable LED lamp of FIG. 1.
Figure 4:
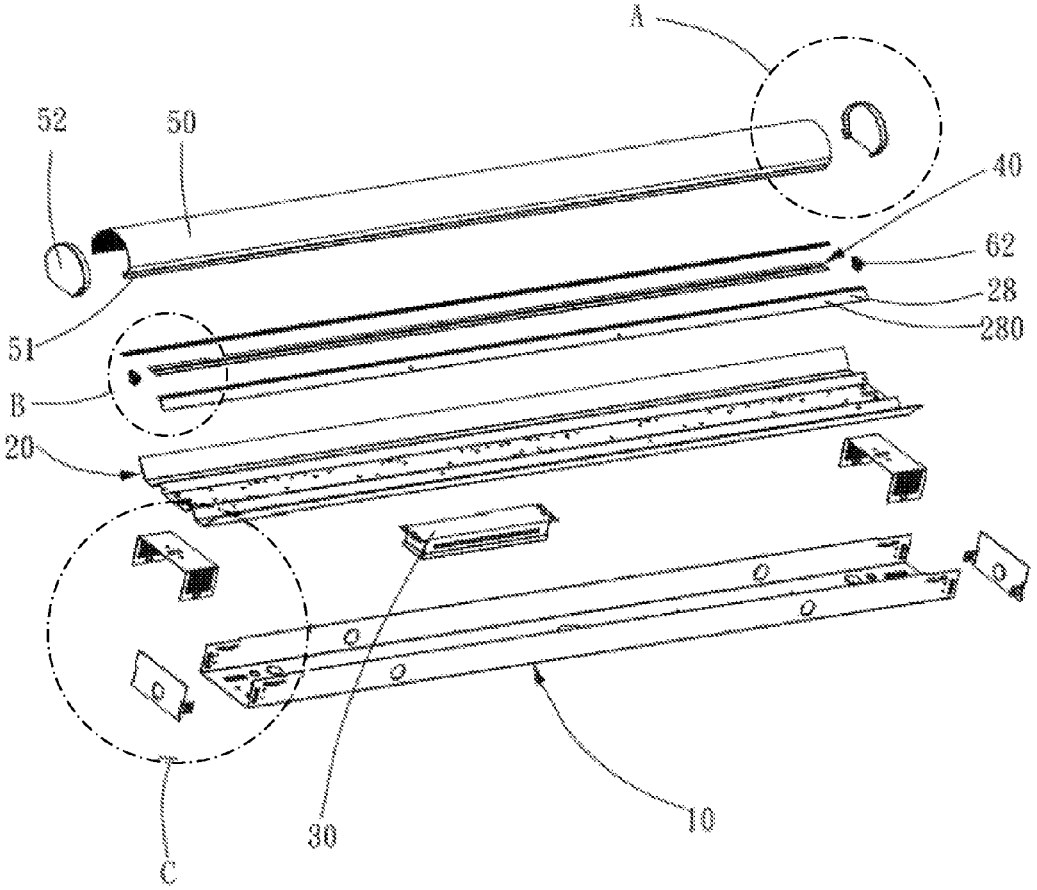
FIG. 4 is an exploded view of the replaceable LED lamp of FIG. 1.
Figure 5:
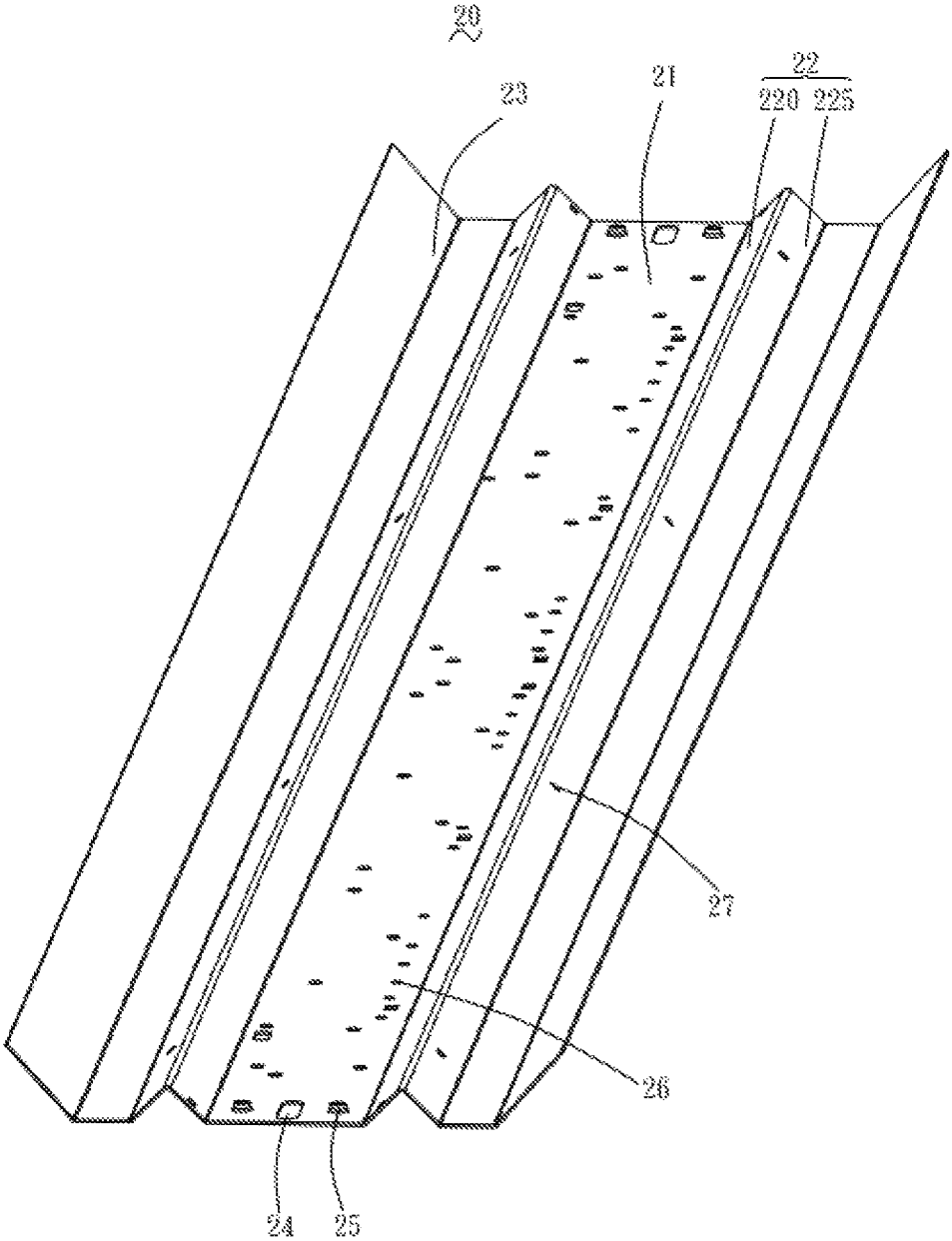
FIG. 5 is a perspective view of a lamp panel of the replaceable LED lamp of FIG. 4.
Figure 6:
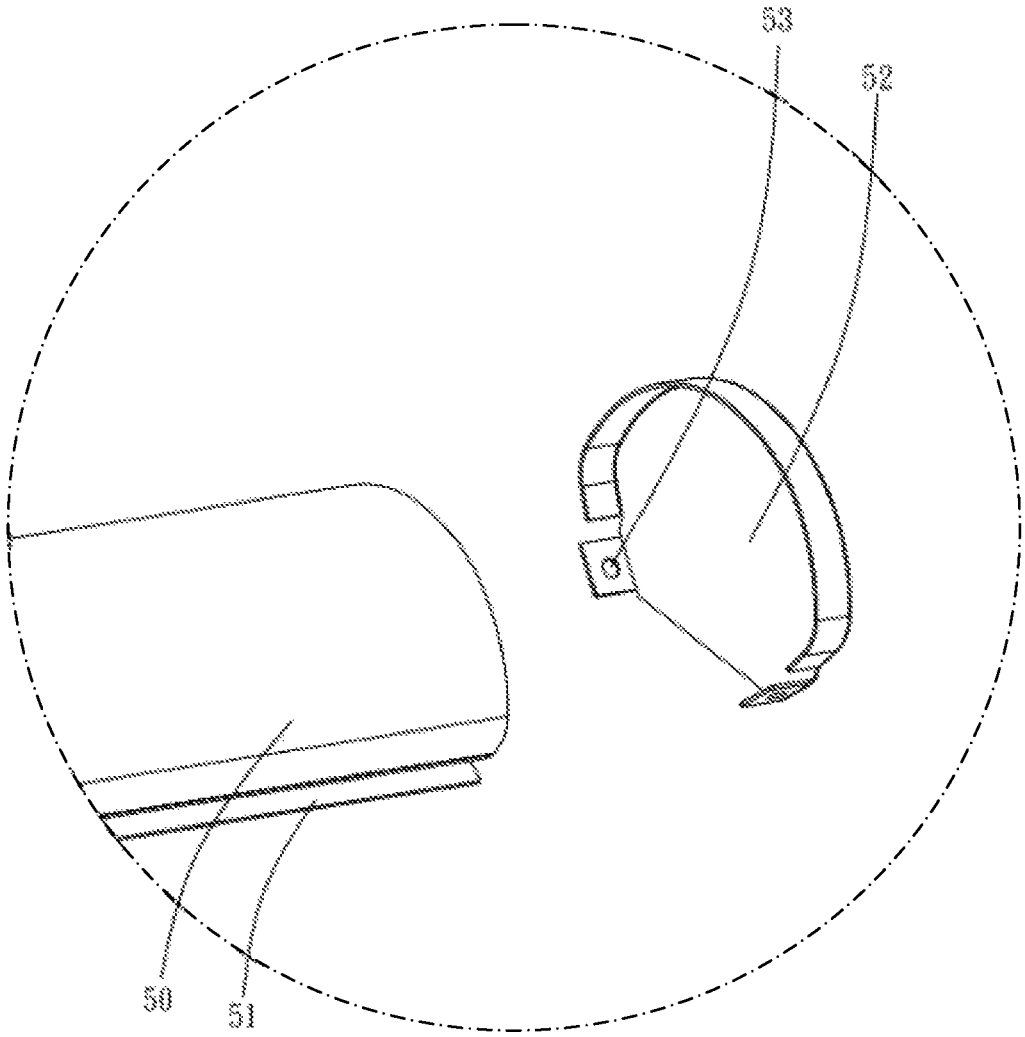
FIG. 6 is an enlarged view of circled portion A of FIG. 4.
Figure 7:
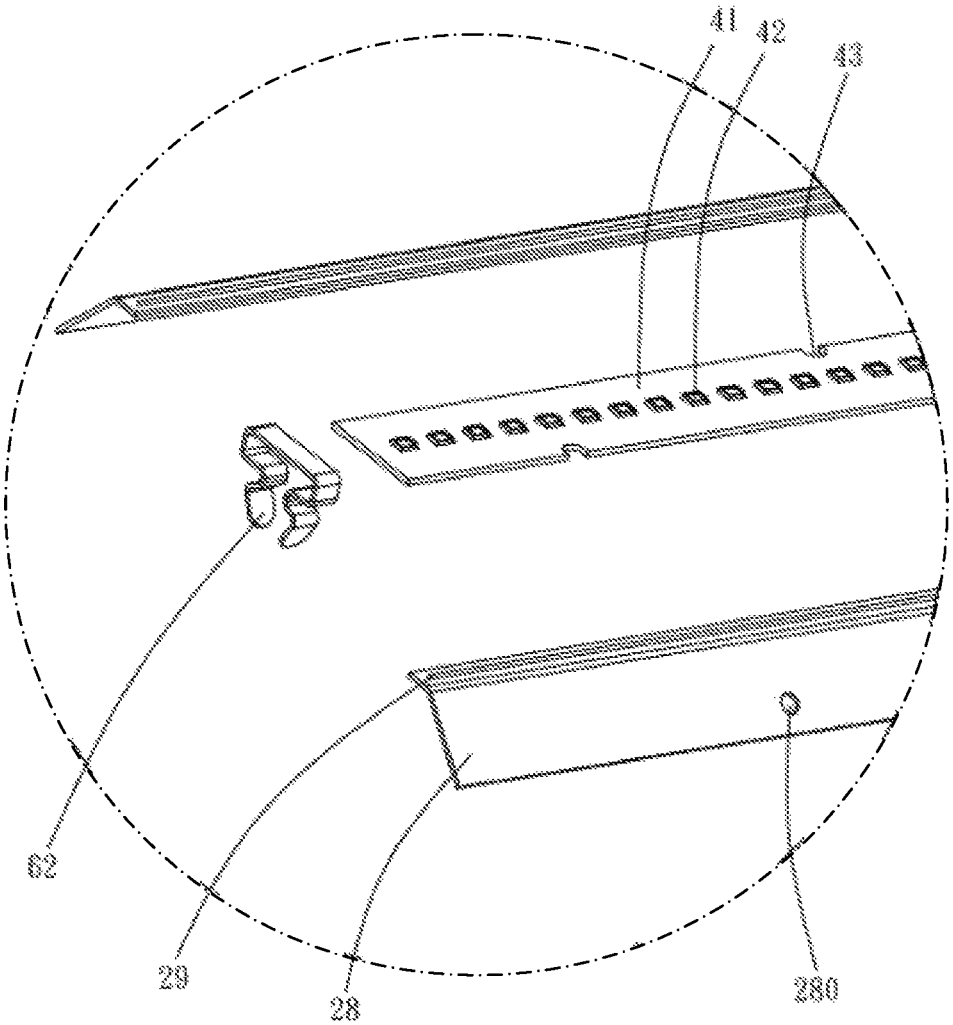
FIG. 7 is an enlarged view of circled portion B of FIG. 4.
Figure 8:
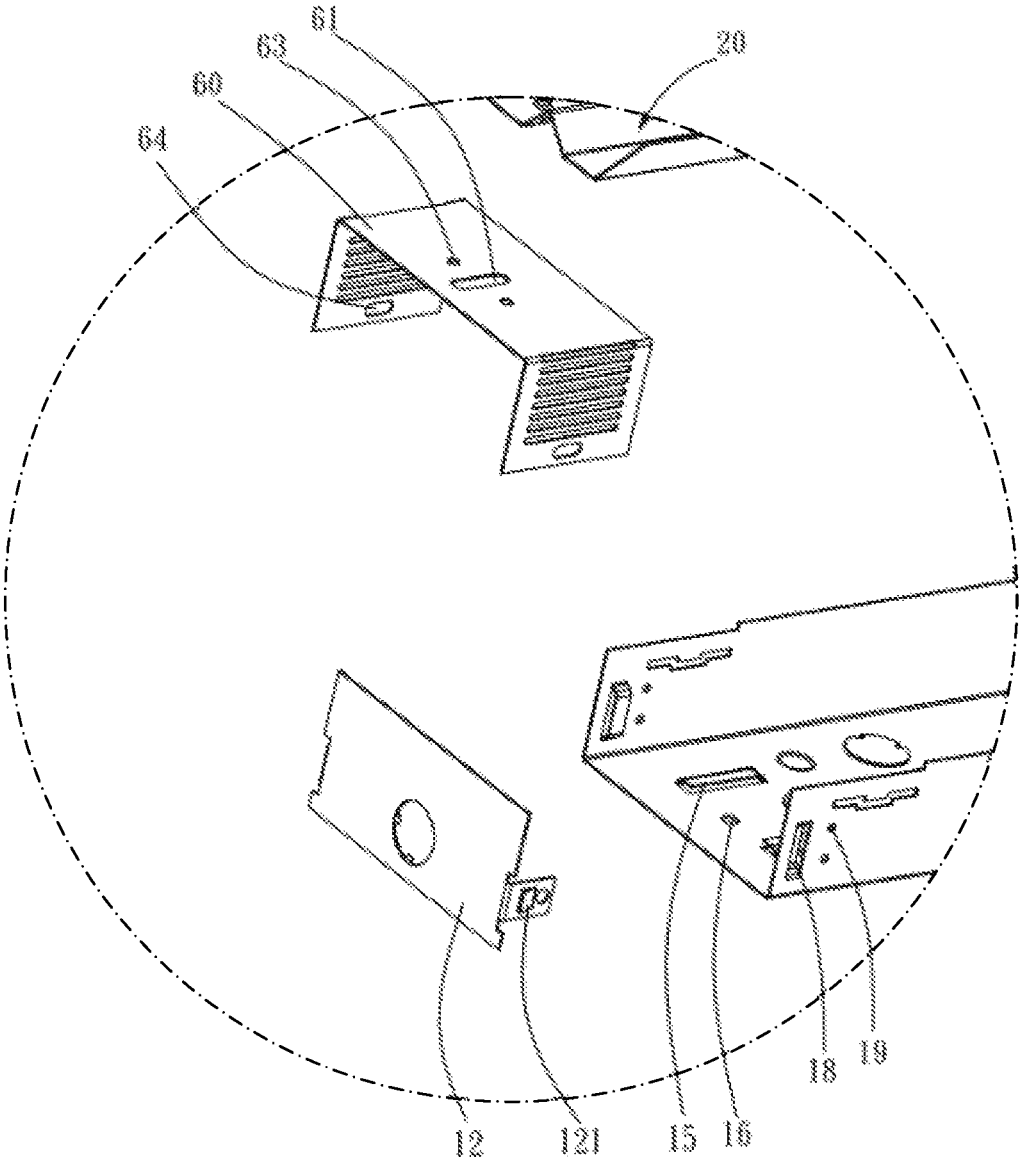
FIG. 8 is an enlarged view of circled portion C of FIG. 4.

Referring to FIG. 1 through FIG. 8, a replaceable LED lamp according to an embodiment of the present disclosure can be mounted on a lamp bracket 10. The replaceable lamp includes a lamp housing 20, a power drive 30 mounted on a side surface of lamp housing 20 facing the lamp bracket 10, a lamp strip 40 mounted on a side surface of lamp housing 20 opposite to the lamp bracket 10, and a lampshade 50 covering the lamp strip 40. The lamp housing 20 is connected to the lamp bracket 10 via a plurality of mounting plates 60. The power drive is located in a frame space between the lamp bracket 10 and the lamp housing 20. Aforementioned LED lamp has a simple structure and a simple assembly. When replacing, it merely requires dismantling the original lamp tube, and a replacement of the overall original lamps is eliminated. Taking advantage of the mounting plate, the replaceable lamp is directly mounted on the original lamp bracket, and the replacement is thus accomplished.

The lamp bracket 10 of the replaceable lamp is the same as the bracket of the original lamp, and includes a lamp bracket main body 11 and two end caps 12 mounted on opposite ends of the lamp bracket main body 11. The lamp bracket main body 11 is formed by stamping an integral metallic sheet, and includes a lamp bracket bottom wall 13 and two lamp bracket sidewalls 14 extending from opposite sides of the lamp bracket bottom wall 13 along a same direction. Opposite ends of an inner surface of the lamp bracket bottom wall 13 are provided with a plurality of supporting bracket openings 15 and a plurality of stamping openings 16, respectively. Both the supporting bracket openings 15 and the stamping openings 16 are configured to assembly the lamp bracket 10. The supporting bracket openings 15 are configured for a hanging assembly. The stamping openings 16 are configured for a fixedly assembly by nails, user can make a choice according to actual requirement. An outer surface of a bottom of the lamp bracket main body 11 is provided with a plurality of protruding lugs 17 each having a hemispherical shape. The protruding lugs 17 resist the wall, and can provide a buffering space for the lamp bracket 10, facilitating for assembly or dismantle. Opposite ends of each lamp bracket sidewall 14 are provided with latching snaps 18, respectively. The latching snap 18 is formed by stamping the lamp bracket sidewall 14. Each latching snap 18 defines a pair of connecting holes 19 at a side. Opposite sides of a width direction of the end cap 12 are provided with a latching pin 121. The latching pin 121 engages the latching snap 18 to accomplish an assembly of the end cap 12 and the lamp bracket main body 11. The lamp bracket 10 is not limited to aforementioned shape, and can include any object features matching such assembly structure.

The lamp housing 20 is formed by stamping an internal metallic sheet, and includes a substrate 21, two mounting portions 22 connected to opposite sides of the substrate 21, and two reflecting portions 23 connected to the two mounting portions 22 respectively. Opposite ends of a top of the substrate 21 define two first mounting holes 24. The first mounting hole 24 has an oval shape, a longitudinal direction of the first mounting hole 24 is coaxial with a longitudinal direction of the lamp housing 20. On opposite ends of substrate 21, opposite sides of the first mounting hole 24 define two screw holes 25. The substrate 21 further defines a plurality of fixing holes (not shown) and a plurality of cooling holes 26. The fixing holes are distributed along a longitudinal direction of the substrate 21, and configured to assembly the lamp strip 40. The cooling hole 26 has various shapes, which are circular, rectangular or oval, respectively. The cooling holes 26 are irregularly distributed on a periphery of the lamp strip 40. The heat generated by the lamp strip 40 in the using process can be dissipated out by the cooling holes 26, avoiding a potential safety hazard generated in the using process due to an excessively high temperature.

Each mounting portion 22 is configured to be a protrusion having a reversed V shape, and defines a first mounting surface 220 and a second mounting surface 225. The first mounting surface 220 faces the lampshade 50, the second mounting surface 225 is opposite to the lampshade 50. Opposite ends of the first mounting surface 220 define a plurality of screw holes 25. The second mounting surface 225 defines a plurality of riveting holes 27, and two latching edges 28 are fixedly assembled via rivets. Each latching edge 28 is a metallic sheet, a surface of the latching edge 28 defines a plurality of second riveting holes 280 and a latching groove 29. The second riveting holes 280 on the latching edge 28 correspond to the first riveting holes 27 on the second mounting surfaces 225. The latching edges 28 can be mounted on the second mounting surfaces 225 by riveting, and the latching edge 28 protrudes out the second mounting surface 225. Each reflecting portion 23 is connected to a side of the mounting portion 22, and can collect and reflect the light from the lamp strip 40, avoiding a waste of the light. The power drive 30 is mounted on a surface of the lamp housing 20 facing the lamp bracket 10. The power drive 30 is located in a frame space between the lamp bracket 10 and the lamp housing 20. The power drive 30 is connected to the lamp strip 40, and supplies power for the lamp strip 40. In an alternative embodiment, the replaceable LED lamp can be driven without a power supply.

The lamp strip 40 includes a lamp board 41 and a plurality of lamp beads 42 uniformly distributed on the lamp board 41. The lamp board 41 is an elongated PCB board, an edge of a longitudinal direction of the lamp board 41 defines a plurality of cutouts 43 which are spaced from each other. The cutout 43 has an optimal arc shape, the locations of the cutouts 43 correspond to the locations of the fixing holes on the substrate 21. The lamp strip 40 can be mounted on the lamp housing 20 by rivets. In the illustrated embodiment, the lamp beads 42 are LED lamp beads, and have characteristics of lower consumption and high efficiency. The lamp beads 42 are connected to each other in a parallel connection. When one LED malfunctions, a normal working of the circuits and the overall luminous reliability can be ensured. It is very important that the overall LED possesses a capacity to continue working, and a failure rate of the overall LED is reduced.

The lampshade 50 covers the lamp strip 40, a cross-section of the lampshade 50 has an "Ω" shape. The lampshade 50 has an outer surface which is a circular smooth surface, and an inner surface of the lampshade 50 is provided with wavy stripes along a width direction thereof. The wavy stripe is formed by arranging a plurality of grooves each having a circular arc cross-section side by side, such arrangements can make the lamplight to be softer, and a dazzle light can be reduced. In an alternative embodiment, the inner surface of the lampshade can be provided with other optical stripes, which are not limited to the wavy stripes. The lampshade 50 includes two opposite latching lugs 51. The latching lug 51 has a V shape configuration. The lampshade 50 has elasticity, after the two latching lugs 51 are exerted by an external force to insert into the latching grooves 29, the external force is then removed. Under an elastic recovery action of the lampshade 50, the latching lugs 51 stably resist the latching edges 28, thereby accomplishing a match and an assembly of the lampshade 50 and the lamp housing 20. Opposite ends of lampshade 50 are provided with two end covers 52. The end cover 52 defines two first connecting holes 53 on opposite sides thereof. The first connecting hole 53 corresponds to the screw hole 25, screws are employed to connect and assembly the end covers 52 to the lampshade 50.

The mounting plate 60 is formed by stamping an integral metallic sheet. Prior to assembly, the mounting plate 60 is a sheet-like planar plate, when assembly, the mounting plate 60 is pressed and bended to form a substantial U shape configuration. The mounting plate 60 defines a second mounting hole 61 on a middle position of a basal surface. The second mounting hole 61 has an oval shape, its longitudinal direction is coaxial with a width direction of the mounting plate 60. The second mounting hole 61 has a position corresponding to a position of the first mounting hole 23. The mounting plate 60 can be connected to the lamp housing 20 via one mounting snap 62. Opposite sides of the second mounting hole 61 define two second connecting holes 63. The second connecting hole 63 corresponds to the screw hole 25. The mounting plate 60 is connected to the lamp housing 20 via screws. Opposite side surfaces of the mounting plate 60 define a plurality of slotted holes which are orderly arranged. A third connecting hole 64 is defined at a side of the slotted hole, the third connecting hole 64 has an oval shape. When assembling the mounting plate 60, the third connecting hole 64 corresponds to the connecting hole 19, and the mounting plate 60 is fixedly connected to the lamp bracket 10 via screws. The used assembly structure can fix the lamp to the assembly bracket by one mounting plate 60, or the used assembly structure is connected to the mounting plate 60, and then the plurality of lamps are connected to each other in a line by head-to-tail connection, and mounted on the bracket.

The aforementioned LED lamp has a simple structure and a simple assembly. When replacing, it merely requires dismantling the original lamp tube, and a replacement of the overall original lamps is eliminated. Taking advantage of the mounting plate, the replaceable lamp is directly mounted on the original lamp bracket, and the replacement is thus accomplished.

Technical features of above embodiments can be combined arbitrary, for simple, any combination of every technical feature in above embodiments is not all illustrated. However, the technical features which are not contradicted to each other may fall into the scope of the specification.

The above are several embodiments of the present invention described in detail, and should not be deemed as limitations to the scope of the present invention. It should be noted that variations and improvements will become apparent to those skilled in the art to which the present invention pertains without departing from its spirit and scope. Therefore, the scope of the present invention is defined by the appended claims.

What is claimed is:

1. A replaceable LED lamp, configured to be mounted on a lamp bracket, the lamp bracket comprising a lamp bracket bottom wall and two lamp bracket sidewalls extending from opposite sides of the lamp bracket bottom wall along the same direction, the replaceable LED lamp comprising: a lamp housing; a power drive mounted on a surface of the lamp housing facing the lamp bracket; a lamp strip mounted on a surface of the lamp housing opposite to the lamp bracket; two latching edges fixed to opposite sides of the lamp housing; a lampshade covering the lamp strip; and a plurality of mounting plates connecting the lamp housing to the lamp bracket; wherein each latching edge defines a latching groove, the lampshade comprises two latching lugs on opposite sides thereof, the latching lug is plugged in the latching groove; wherein the lamp housing comprises a substrate and two mounting portions connected to opposite sides of the substrate, each mounting portion is configured to be a protrusion having a reversed V shape, and each mounting portion comprises a first mounting surface and a second mounting surface, the first mounting surface faces the lampshade, the second mounting surface is opposite to the lampshade, the latching edge is fixed to the second mounting surface of the corresponding mounting portion.

2. The replaceable LED lamp according to claim 1, wherein the lamp housing further comprises two reflecting portions, each reflecting portion is connected to a side of the corresponding mounting portion.

3. The replaceable LED lamp according to claim 1, wherein the latching edge is a metallic sheet, a surface of the latching edge defines a plurality of second riveting holes and the latching groove, the latching edge is mounted on the second mounting surface and protrudes out the second mounting surface.

4. The replaceable LED lamp according to claim 1, wherein both the substrate and the second mounting surface define a plurality of first riveting holes to receive rivets.

5. The replaceable LED lamp according to claim 4, wherein the lamp strip comprises a lamp board and a plurality of LED lamp beads mounted on the lamp board, the lamp board defines a plurality of cutouts at an edge thereof, the plurality of cutouts are spaced from each other and uniformly distributed, the cutouts correspond to the first riveting holes.

6. The replaceable LED lamp according to claim 1, wherein a cross-section of the lampshade has an "Ω" shape, opposite ends of the lampshade are provided with two end covers, and the lampshade has elasticity.

7. The replaceable LED lamp according to claim 6, wherein the lampshade has a circular outer surface which is smooth, and an inner surface of the lampshade is provided with wavy stripes.

8. The replaceable LED lamp according to claim 1, wherein the mounting plate has a substantially "U" shaped configuration, and is formed by stamping an integral metallic sheet.

* * * * *